US010276080B2

(12) United States Patent
Pan et al.

(10) Patent No.: US 10,276,080 B2
(45) Date of Patent: Apr. 30, 2019

(54) RGBW PIXEL RENDERING DEVICE AND METHOD

(71) Applicant: Wuhan China Star Optoelectronics Technology Co., Ltd., Wuhan, Hubei (CN)

(72) Inventors: Biao Pan, Guangdong (CN); Xinhui Zhong, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 109 days.

(21) Appl. No.: 15/328,898

(22) PCT Filed: Dec. 29, 2016

(86) PCT No.: PCT/CN2016/113104

§ 371 (c)(1),
(2) Date: Jan. 24, 2017

(87) PCT Pub. No.: WO2018/119909

PCT Pub. Date: Jul. 5, 2018

(65) Prior Publication Data

US 2018/0211577 A1 Jul. 26, 2018

(30) Foreign Application Priority Data

Dec. 27, 2016 (CN) ..... 2016 1 1229628

(51) Int. Cl.
*G09G 3/20* (2006.01)
*G09G 3/32* (2016.01)
(Continued)

(52) U.S. Cl.
CPC ..... *G09G 3/2003* (2013.01); *G09G 3/3208* (2013.01); *G09G 3/3607* (2013.01);
(Continued)

(58) Field of Classification Search
USPC ..... 345/589
See application file for complete search history.

(56) References Cited

U.S. PATENT DOCUMENTS 9,311,688 B1 * 4/2016 Rosenberg ..... G06T 1/20
2009/0092325 A1 * 4/2009 Brown Elliott ..... G09G 3/20 382/232

(Continued)

FOREIGN PATENT DOCUMENTS

CN 1905621 A 1/2007
CN 105575314 A 5/2015

(Continued)

*Primary Examiner* — Wesner Sajous
(74) *Attorney, Agent, or Firm* — Andrew C. Cheng

(57) ABSTRACT

The disclosure provides a RGBW pixel rendering device, including a collecting module obtaining a RGB grayscale value, converters converting the RGB grayscale value to a RGB brightness value and converting a second RGBW brightness value to a RGBW grayscale value to be output, a sampler, converting the RGB brightness value to a first RGBW brightness value, a judging element obtaining saturation values and brightness values, and calculating the saturation values and the brightness values respectively to obtain a saturation value difference and a brightness value difference for judging, a rendering element rendering the first RGBW brightness value according to an outcome to obtain the second RGBW brightness values. The disclosure further provides a rendering method. Compared with the prior art, the display has relatively high resolution without losing details.

10 Claims, 4 Drawing Sheets

(51) Int. Cl.

| | |
|---|---|
| ***G09G 5/02*** | (2006.01) |
| ***H04N 1/60*** | (2006.01) |
| ***H04N 5/202*** | (2006.01) |
| ***H04N 9/64*** | (2006.01) |
| ***H04N 9/77*** | (2006.01) |
| ***G06T 11/00*** | (2006.01) |
| ***G09G 3/3208*** | (2016.01) |
| *G09G 3/36* | (2006.01) |

(52) U.S. Cl.
CPC ..... *G09G 2300/0452* (2013.01); *G09G 2320/0626* (2013.01); *G09G 2320/0673* (2013.01); *G09G 2340/06* (2013.01); *G09G 2360/16* (2013.01)

(56) References Cited

U.S. PATENT DOCUMENTS

2015/0097854 A1 4/2015 Park
2015/0348506 A1* 12/2015 Ooga ..... G09G 5/10 345/205
2015/0363944 A1 12/2015 Elliott
2015/0364081 A1* 12/2015 Tseng ..... G09G 3/3413 345/694
2016/0117975 A1* 4/2016 Kang ..... G09G 3/2003 345/694
2017/0110044 A1* 4/2017 Ahn ..... G09G 3/2003
2018/0174529 A1* 6/2018 de Greef ..... G09G 3/348

FOREIGN PATENT DOCUMENTS

CN 104680945 A 6/2015
CN 104732924 A 6/2015
CN 104952423 A 9/2015
CN 105261321 A 1/2016
CN 105336288 A 2/2016
CN 105609033 A 5/2016
CN 105913806 A 8/2016
CN 105931605 A 9/2016

* cited by examiner

RGBW PIXEL RENDERING DEVICE AND METHOD

TECHNICAL FIELD

The disclosure relates to a liquid crystal display technology, and more particularly to a RGBW pixel rendering device and a method.

DESCRIPTION OF RELATED ART

Defects of a conventional three primary colored display system are exposing with development of living standard and constant improvement of display technique, an increasing requirement can hardly be satisfied. It is mainly reflected in reduction of aperture ratio of pixels and optical transmittance of a screen caused by enhancement of screen resolution, resulting in additional power consumption of backlight and the entire screen.

Unlike a conventional RGB display, a RGBW display includes a white (W) sub-pixel besides red (R), green (G) and blue (B) sub-pixels. Attendance of the white sub-pixel can significantly improve transmittance of a LCD and luminous efficiency of unit area in an OLED display, accordingly to chase objectives of low power consumption, energy saving and environmental protection.

In the same design of pixels, as an extra W sub-pixel in RGBW, the physical resolution will be reduced correspondingly. In a RGBW display device, in order to raise the actual resolution of the display, a method of sub-pixel rendering (SPR) is required to be adopted.

However, the RGBW display device based on a conventional SPR method will lose details to an extent caused by loss of partial sub-pixel information in a conversion process from input RGB signals to output RGBW signals. Meanwhile, texts and images are totally different display contents, but the conventional SPR method treats texts and images in an identical manner, the manner will lead to numerous problems such as insufficient brightness of the texts in display, obscure of details and failure in displaying smoothly of images.

Therefore, a RGBW pixel rendering method processing texts and images respectively to ensure the display having relatively high resolution with full details is desiderated.

SUMMARY

The disclosure provides a RGBW pixel rendering device and a method to guarantee the display device has relatively high resolution without losing details in display.

The disclosure provides a RGBW pixel rendering device, the rendering device includes a collecting module, converters, a sampler, a determining element and a rendering element.

The collecting module is configured to obtain a RGB grayscale value of three primary color components of each pixel of an original image in a RGB color space and send the RGB grayscale value to the converters.

The converters are configured to obtain a brightness value of RGB by De-Gamma conversion of the RGB grayscale value and send the brightness value of RGB to the sampler, as well as obtaining a RGBW grayscale value of a pixel by Gamma conversion of a second RGBW brightness value and outputting the RGBW grayscale value.

The sampler is configured to convert the brightness value of RGB to a first RGBW brightness value and send the first RGBW brightness value to the rendering element.

The determining element is configured to obtain saturation values and brightness values of two pixels in each group in the original image with two pixels as a group, and obtain a saturation difference and a brightness difference by respective subtraction of the saturation values and the brightness values; determining according to the saturation difference and the brightness difference of the two pixels in each groups to obtain an outcome and sending the outcome to the rendering element.

The rendering element is configured to render the first RGBW brightness value according to the outcome to obtain a second RGBW brightness value after rendering and send the second RGBW brightness value to the converters for conversion.

Optionally, the converters include a first converter and a second converter.

The first converter is configured to obtain the brightness value of RGB by De-Gamma conversion of the RGB grayscale value and send the brightness value of RGB to the sampler.

The second converter is configured to obtain the RGBW grayscale value of the pixel by Gamma conversion of the second RGBW brightness value and output the RGBW grayscale value.

Optionally, a determining criterion of the determining element determining according to the saturation difference and the brightness difference of the two pixels in each groups is determining if the saturation differences of each of the groups are all less than a first threshold and the brightness differences of each of the groups are all more than a second threshold, if the saturation differences of each of the groups are all less than the first threshold and the brightness differences of each of the groups are all more than the second threshold, the determining element determines the original image to be a text mode, otherwise, the determining element determines the original image to be an image mode.

Optionally, when the outcome is the image mode, the rendering element renders by averaging a sum of the brightness values of sub-pixels of an identical type in the first RGBW brightness values of two pixels of each of the groups to obtain the second RGBW brightness value.

Optionally, when the outcome is the text mode, the rendering element calculates total brightness values of the first RGBW brightness values of two pixels of each of the groups respectively, and determines the total brightness values of the two pixels to obtain the corresponding second RGBW brightness value, calculation of the total brightness value of the pixels follows a formula below:

$$P_n = W_n + \frac{R_n + G_n + B_n}{3}$$

Brightness values of four sub-pixels included in the first RGBW brightness value of the pixel are respectively $W_n$, $R_n$, $G_n$ and $B_n$, n is a serial number of a position where the pixel is in the original image, $P_n$ is the total brightness value of the pixel, the formula above obtains the total brightness value of the first RGBW brightness value of the pixel.

When the total brightness value of the pixel on the left of the two pixels in each of the groups is larger than the total brightness value of the pixel on the right of the two pixels in each of the groups, a sum of brightness values of a W sub-pixel in the first RGBW brightness value of the two pixels is averaged to be the brightness value of rendered W sub-pixel, the total brightness values of the pixels on the right side are regarded as brightness values of rendered RGB three sub-pixels respectively, so as to obtain the second RGBW brightness value.

When the total brightness value of the pixels on the left is smaller than the total brightness value of the pixels on the right, the total brightness of the pixels on the left is regarded as the brightness value of rendered W sub-pixel, a sum of brightness values of a R sub-pixel in the first RGBW brightness value of the two pixels is averaged to be the brightness value of rendered R sub-pixel, a sum of brightness values of a G sub-pixel in the first RGBW brightness value of the two pixels is averaged to be the brightness value of rendered G sub-pixel, a sum of brightness values of a B sub-pixel in the first RGBW brightness value of the two pixels is averaged to be the brightness value of rendered B sub-pixel, the second RGBW brightness value is achieved.

The disclosure further provides a RGBW pixel rendering method, including following steps.

Step 1, obtaining a RGB grayscale value of three primary color components of each pixel of an original image in a RGB color space by a collecting module;

Step 2, converting the RGB grayscale value to obtain a brightness value of RGB by De-Gamma conversion by converters.

Step 3, converting the brightness value of RGB to a first RGBW brightness value by a sampler.

Step 4, obtaining saturation values and brightness values of two pixels in each group in the original image with two pixels as a group, obtaining a saturation difference and a brightness difference by respective subtraction of the saturation values and the brightness values then obtaining an outcome according to the saturation difference and the brightness difference of the two pixels in each group by a determining element.

Step 5, rendering the first RGBW brightness value according to the outcome to obtain a second RGBW brightness value by a rendering element;

Step 6, obtaining a RGBW grayscale value of a pixel by Gamma conversion of the second RGBW brightness value and outputting the RGBW grayscale value by the converters.

Optionally, the converters include a first converter and a second converter.

After the collecting module sends the RGB grayscale value to the converter, the first converter obtains the brightness value of RGB by De-Gamma conversion of the RGB grayscale value and sends the brightness value of RGB to the sampler.

After the rendering element sends the rendered second RGBW brightness value to the converters, the second converter obtains a RGBW grayscale value of the pixel by Gamma conversion of the second RGBW brightness value and outputs the RGBW grayscale value.

Optionally, a determining criterion of the determining element determining according to the saturation difference and the brightness difference of the two pixels in each groups in the step 4 is determining if the saturation differences of each of the groups are all less than a first threshold and the brightness differences of each of the groups are all more than a second threshold, if the saturation differences of each of the groups are all less than the first threshold and the brightness differences of each of the groups are all more than the second threshold, the determining element determines the original image to be a text mode, otherwise, the determining element determines the original image to be an image mode.

Optionally, when the outcome is the image mode, the rendering element renders by averaging a sum of the brightness values of sub-pixels of an identical type in the first RGBW brightness values of two pixels of each of the groups to obtain the second RGBW brightness value.

Optionally, when the outcome is the text mode, the rendering element calculates total brightness values of the first RGBW brightness values of two pixels of each of the groups respectively, and determines the total brightness value of the two pixels to obtain the corresponding second RGBW brightness value, calculation of the total brightness value of the pixels follows a formula below:

$$P_n = W_n + \frac{R_n + G_n + B_n}{3}$$

Brightness values of four sub-pixels included in the first RGBW brightness value of the pixel are respectively $W_n$, $R_n$, $G_n$ and $B_n$, n is a serial number of a position where the pixel is in the original image, $P_n$ is the total brightness value of the pixel, the formula above obtains the total brightness value of the pixel.

When the total brightness value of the pixel on the left of the two pixels in each of the groups is larger than the total brightness value of the pixel on the right of the two pixels in each of the groups, a sum of brightness values of a W sub-pixel in the first RGBW brightness value of the two pixels is averaged to be the brightness value of rendered W sub-pixel, the total brightness values of the pixels on the right side are regarded as brightness values of rendered RGB three sub-pixels respectively, so as to obtain the second RGBW brightness value.

When the total brightness value of the pixels on the left is smaller than the total brightness value of the pixels on the right, the total brightness value of the pixels on the left is regarded as the brightness value of rendered W sub-pixel, a sum of brightness values of a R sub-pixel in the first RGBW brightness value of the two pixels is averaged to be the brightness value of rendered R sub-pixel, a sum of brightness values of a G sub-pixel in the first RGBW brightness value of the two pixels is averaged to be the brightness value of rendered G sub-pixel, a sum of brightness values of a B sub-pixel in the first RGBW brightness value of the two pixels is averaged to be the brightness value of rendered B sub-pixel, the second RGBW brightness value is achieved.

Compared with the prior art, the disclosure obtains the grayscale value of three primary color components of each pixel of an original image in a RGB color space and converts to the RGB brightness value, and obtains the second RGBW grayscale value by Gamma conversion according to different display modes after converting the RGB brightness value to the RGBW brightness value and outputs the second RGBW grayscale value, so that the display has relatively high resolution without losing details, texts and images are processed respectively. Images are processed to be displayed more smoothly, texts are processed to be brightened to clarify details.

DETAILED DESCRIPTION OF PREFERRED EMBODIMENTS

Embodiments of the disclosure will be described in detail with reference to the accompanying drawings as follows.

Figure 1:
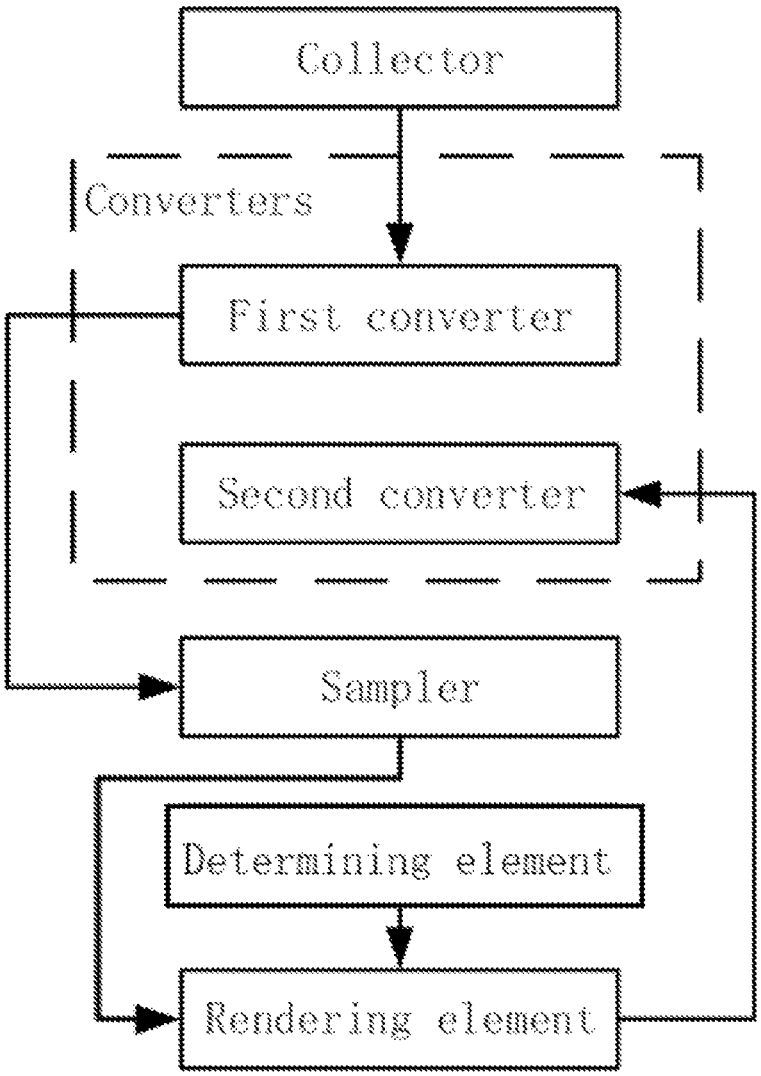
FIG. 1 is a structural block diagram of a RGBW rendering device according to the disclosure.

As shown in FIG. 1, a RGBW pixel rendering device of the disclosure includes a collecting module, converters, a sampler, a determining element and a rendering element.

The collecting module is configured to obtain a RGB grayscale value of three primary color components of each pixel of an original image in a RGB color space and send the RGB grayscale value to the converters.

The converters are configured to obtain a brightness value of RGB by De-Gamma conversion of the RGB grayscale value and send the brightness value of RGB to the sampler, as well as obtaining a RGBW grayscale value of a pixel by Gamma conversion of a second RGBW brightness value and outputting the RGBW grayscale value.

The sampler is configured to convert the brightness value of RGB to a first RGBW brightness value and send the first RGBW brightness value to the rendering element.

The determining element is configured to obtain saturation values and brightness values of two pixels in each group in the original image with two pixels as a group, and obtain a saturation difference and a brightness difference by respective subtraction of the saturation values and the brightness values; determining according to the saturation difference and the brightness difference of the two pixels in each groups to obtain an outcome and sending the outcome to the rendering element.

The rendering element is configured to render the first RGBW brightness value according to the outcome to obtain a second RGBW brightness value after rendering and send the second RGBW brightness value to the converters for conversion.

Optionally, the converters of the disclosure include a first converter and a second converter.

The first converter is configured to obtain the brightness value of RGB by De-Gamma conversion of the RGB grayscale value and send the brightness value of RGB to the sampler.

The second converter is configured to obtain the RGBW grayscale value of the pixel by Gamma conversion of the second RGBW brightness value and output the RGBW grayscale value.

A determining criterion of the determining element determining according to the saturation difference and the brightness difference of the two pixels in each groups is determining if the saturation differences of each of the groups are all less than a first threshold and the brightness differences of each of the groups are all more than a second threshold, if the saturation differences of each of the groups are all less than the first threshold and the brightness differences of each of the groups are all more than the second threshold, the determining element determines the original image to be a text mode, otherwise, the determining element determines the original image to be an image mode, the first threshold is 1.3, the second threshold is 0.3.

When the outcome is the image mode, the rendering element renders by averaging a sum of the brightness values of sub-pixels of an identical type in the first RGBW brightness values of two pixels of each of the groups to obtain the second RGBW brightness value.

When the outcome is the text mode, the rendering element calculates total brightness values of the first RGBW brightness values of two pixels of each of the groups respectively, and determines the total brightness values of the two pixels to obtain the corresponding second RGBW brightness value.

When the total brightness value of the pixel on the left of the two pixels in each of the groups is larger than the total brightness value of the pixel on the right of the two pixels in each of the groups, a sum of brightness values of a W sub-pixel in the first RGBW brightness value of the two pixels is averaged to be the brightness value of rendered W sub-pixel, the total brightness values of the pixels on the right side are regarded as brightness values of rendered RGB three sub-pixels respectively, so as to obtain the second RGBW brightness value.

When the total brightness value of the pixel on the left of the two pixels in each of the groups is smaller than the total brightness value of the pixel on the right of the two pixels in each of the groups, the total brightness of the pixels on the left is regarded as the brightness value of rendered W sub-pixel, a sum of brightness values of a R sub-pixel in the first RGBW brightness value of the two pixels is averaged to be the brightness value of rendered R sub-pixel, a sum of brightness values of a G sub-pixel in the first RGBW brightness value of the two pixels is averaged to be the brightness value of rendered G sub-pixel, a sum of brightness values of a B sub-pixel in the first RGBW brightness value of the two pixels is averaged to be the brightness value of rendered B sub-pixel, the second RGBW brightness value is achieved.

Figure 2:
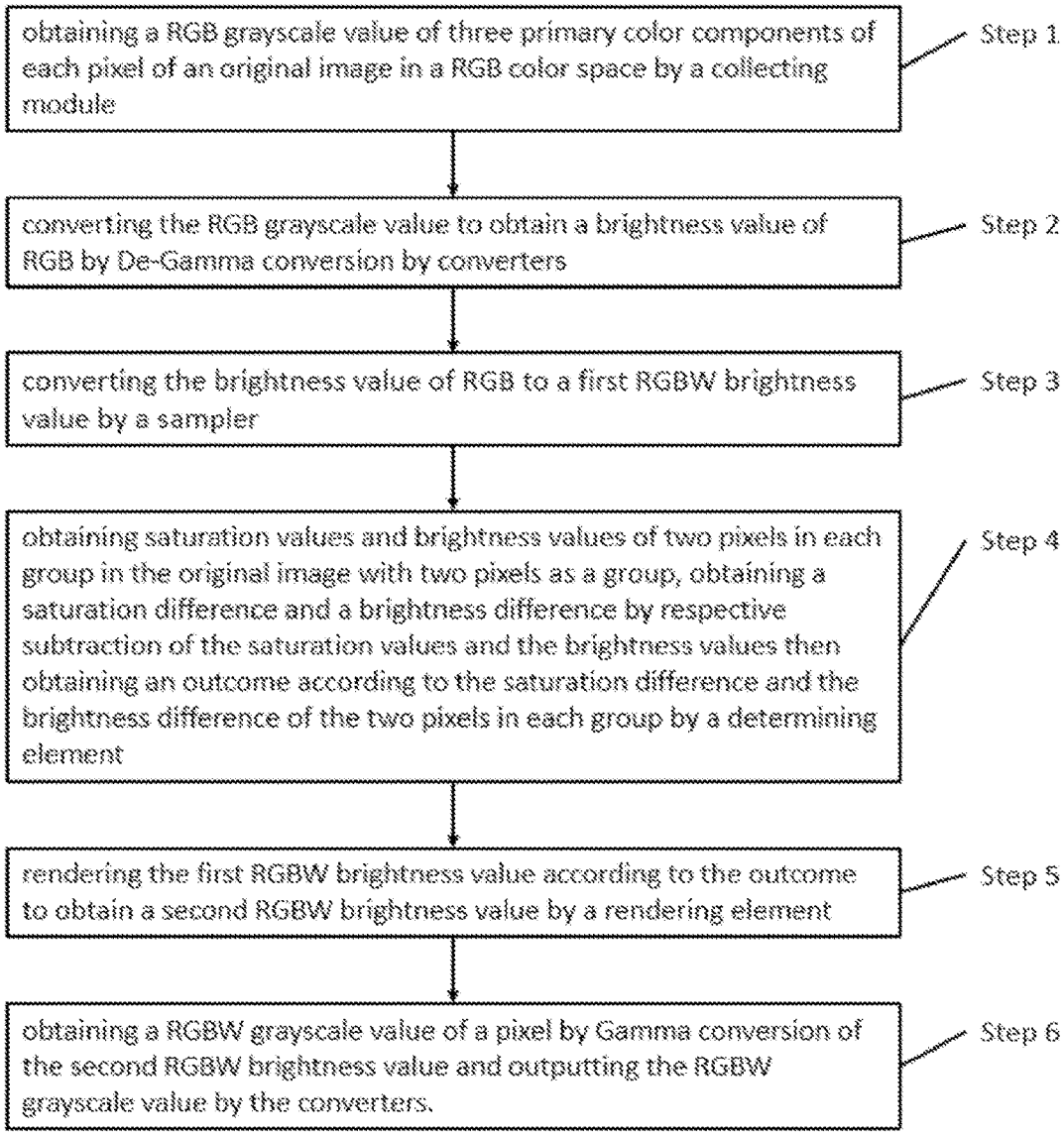
FIG. 2 is a flowchart of a rendering method according to the disclosure.

As shown in FIG. 2, a RGBW pixel rendering method of the disclosure includes following steps.

Step 1, obtaining a RGB grayscale value of three primary color components of each pixel of an original image in a RGB color space by a collecting module.

Step 2, converting the RGB grayscale value to obtain a brightness value of RGB by De-Gamma conversion by converters.

Step 3, converting the brightness value of RGB to a first RGBW brightness value by a sampler.

Step 4, obtaining saturation values and brightness values of two pixels in each group in the original image with two pixels as a group, obtaining a saturation difference and a brightness difference by respective subtraction of the saturation values and the brightness values then obtaining an outcome according to the saturation difference and the brightness difference of the two pixels in each group by a determining element.

Step 5, rendering the first RGBW brightness value according to the outcome to obtain a second RGBW brightness value by a rendering element;

Step 6, the converters obtaining a RGBW grayscale value of a pixel by Gamma conversion of the second RGBW brightness value and outputting the RGBW grayscale value by the converters.

Optionally, the converters include a first converter and a second converter.

After the collecting module sends the RGB grayscale value to the converter, the first converter obtains the brightness value of RGB by De-Gamma conversion of the RGB grayscale value and sends the brightness value of RGB to the sampler.

After the rendering element sends the rendered second RGBW brightness value to the converters, the second converter obtains a RGBW grayscale value of the pixel by Gamma conversion of the second RGBW brightness value and outputs the RGBW grayscale value.

A determining criterion of the determining element determining according to the saturation difference and the brightness difference of the two pixels in each groups in the step 4 is determining if the saturation differences of each of the groups are all less than a first threshold and the brightness differences of each of the groups are all more than a second threshold, if the saturation differences of each of the groups are all less than the first threshold and the brightness differences of each of the groups are all more than the second threshold, the determining element determines the original image to be a text mode, otherwise, the determining element determines the original image to be an image mode.

When the outcome is the image mode, the rendering element renders by averaging a sum of the brightness values of sub-pixels of an identical type in the first RGBW brightness values of two pixels of each of the groups to obtain the second RGBW brightness value.

When the outcome is the text mode, the rendering element calculates total brightness values of the first RGBW brightness values of two pixels of each of the groups respectively, and determines the total brightness value of the two pixels to obtain the corresponding second RGBW brightness value.

When the total brightness value of the pixel on the left of the two pixels in each of the groups is larger than the total brightness value of the pixel on the right of the two pixels in each of the groups, a sum of brightness values of a W sub-pixel in the first RGBW brightness value of the two pixels is averaged to be the brightness value of rendered W sub-pixel, the total brightness values of the pixels on the right side are regarded as brightness values of rendered RGB three sub-pixels respectively, so as to obtain the second RGBW brightness value.

When the total brightness value of the pixel on the left of the two pixels in each of the groups is smaller than the total brightness value of the pixel on the right of the two pixels in each of the groups, the total brightness value of the pixels on the left is regarded as the brightness value of rendered W sub-pixel, a sum of brightness values of a R sub-pixel in the first RGBW brightness value of the two pixels is averaged to be the brightness value of rendered R sub-pixel, a sum of brightness values of a G sub-pixel in the first RGBW brightness value of the two pixels is averaged to be the brightness value of rendered G sub-pixel, a sum of brightness values of a B sub-pixel in the first RGBW brightness value of the two pixels is averaged to be the brightness value of rendered B sub-pixel, the second RGBW brightness value is achieved.

Two as a group sequentially in the disclosure is specifically according to positions of pixels in the original image with a sequence in each line, two pixels are as one group, such as positions of pixels in the first line are 1, 2, 3, 4, 5, 6, 7, 8, . . . , in the first line, pixels on positions 1 and 2 are as a group, pixels on positions 3 and 4 are as a group, pixels on positions 5 and 6 are as a group, pixels on positions 7 and 8 are as a group, so on and so forth.

When the disclosure determines the outcome to be the image mode, the rendering element renders by averaging a sum of sub-pixels of an identical type in two pixels of each of the groups to obtain the second RGBW brightness value.

Figure 3:
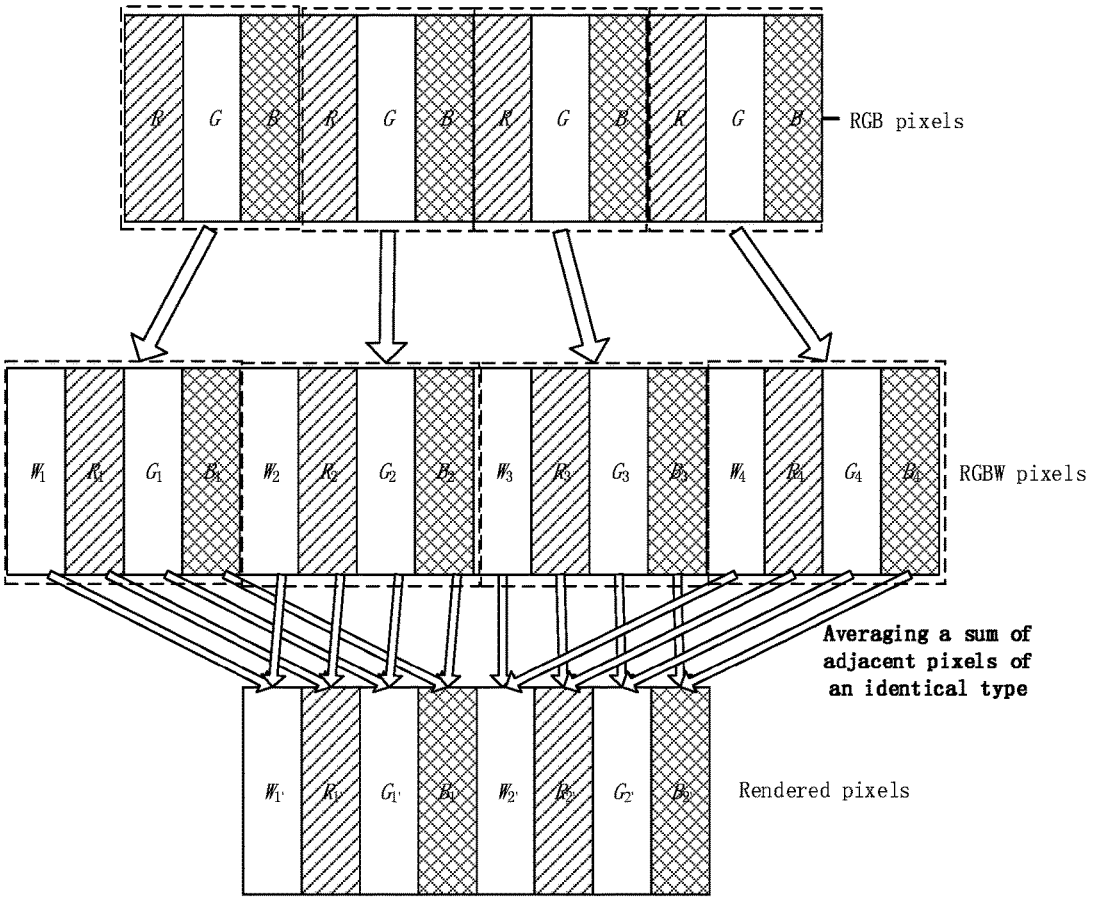
FIG. 3 is a schematic view of pixel rendering in an image mode according to the disclosure.

Specifically as shown in FIG. 3, brightness values of sub-pixels included in the first RGBW brightness value of each of the pixels are supposed to be ($W_n$, $R_n$, $G_n$; $B_n$), n is a serial number of a position where the pixel is in the original image, four pixels are adopted to be an example, the four pixels are respectively ($W_1$, $R_1$, $G_1$, $B_1$), ($W_2$, $R_2$, $G_2$, $B_2$), ($W_3$, $R_3$, $G_3$, $B_3$), ($W_4$, $R_4$, $G_4$, $B_4$), via formulas:

$$\begin{cases} W_{1'} = \dfrac{(W_1 + W_2)}{2} \\ R_{1'} = \dfrac{(R_1 + R_2)}{2} \\ G_{1'} = \dfrac{(G_1 + G_2)}{2} \\ B_{1'} = \dfrac{(B_1 + B_2)}{2} \end{cases}, \quad \begin{cases} W_{2'} = \dfrac{(W_3 + W_4)}{2} \\ R_{2'} = \dfrac{(R_3 + R_4)}{2} \\ G_{2'} = \dfrac{(G_3 + G_4)}{2} \\ B_{2'} = \dfrac{(B_3 + B_4)}{2} \end{cases}$$

Finally, the second RGBW brightness values are obtained respectively, the result is to smooth transition among adjacent pixels in the image display mode. An image, especially a portrait, will has a more ideal display effect. The photo-editing function in some photo processors is exactly the smooth method.

When the disclosure determines the outcome to be the text mode, the rendering element obtains the corresponding second RGBW brightness value according to the total brightness value of two adjacent pixels.

Figure 4:
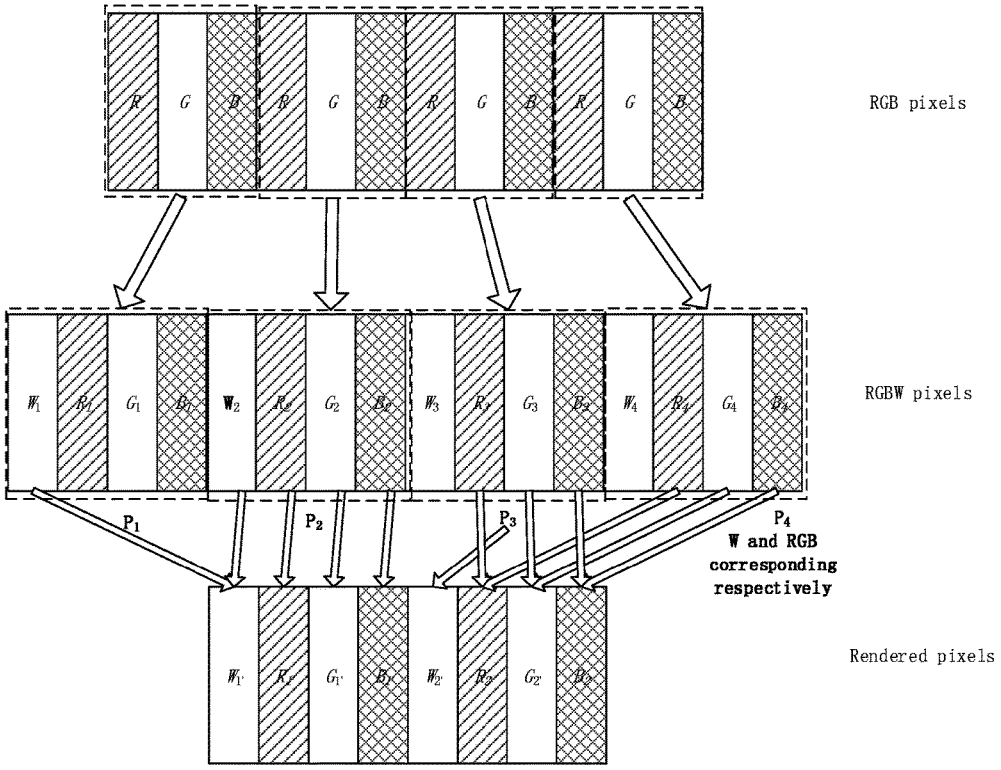
FIG. 4 is a schematic view of pixel rendering in a text mode according to the disclosure.

Specifically as shown in FIG. 4, brightness values of four sub-pixels included in the first RGBW brightness value of the pixel are supposed to be ($W_n$, $R_n$, $G_n$, $B_n$), n is a serial number of a position where the pixel is in the original image, $P_n$ is the total brightness value of the pixel, the formula is as follows.

$$P_n = W_n + \frac{R_n + G_n + B_n}{3}$$

Four pixels are taken as an example, brightness values of four sub-pixels in the first RGBW brightness value of the four pixels are respectively ($W_1$, $R_1$, $G_1$, $B_1$), ($W_2$, $R_2$, $G_2$, $B_2$), ($W_3$, $R_3$, $G_3$, $B_3$), ($W_4$, $R_4$, $G_4$, $B_4$), the total brightness values $P_n$ of the four pixels can be achieved by the following formula respectively.

$$\begin{cases} P_1 = W_1 + \dfrac{(R_1 + G_1 + B_1)}{3} \\ P_2 = W_2 + \dfrac{(R_2 + G_2 + B_2)}{3} \\ P_3 = W_3 + \dfrac{(R_3 + G_3 + B_3)}{3} \\ P_4 = W_4 + \dfrac{(R_4 + G_4 + B_4)}{3} \end{cases}$$

In the four calculated pixels above, in an order of two as a group, when a total brightness value $P_1$ of pixel on the left is larger than a total brightness value $P_2$ of the pixel on the right of the two pixels in the group on the left side, a sum of the brightness values of the W sub-pixels in the two pixels is averaged to be the brightness value of rendered W sub-pixel, and the total brightness values of the pixels on the right are regarded as the brightness values of rendered RGB three sub-pixels respectively, so as to obtain the second RGBW brightness value, a specific formula is:

$$\begin{cases} W_{1'} = \dfrac{(W_1 + W_2)}{2} \\ R_{1'} = P_2 \\ G_{1'} = P_2 \\ B_{1'} = P_2 \end{cases}$$

As $P_1$ is dim and $P_2$ is bright, the result is a more sharp difference between contrasts in light, which can improve a display effect of texts.

In the four calculated pixels, when a total brightness value $P_3$ of pixel on the left of the two pixels in the group on the right side is smaller than a total brightness value $P_4$ of the pixel on the right, the total brightness value $P_3$ of pixel on the left acts as the brightness value of rendered W sub-pixel, a sum of brightness values of RGB three sub-pixels respectively in the first RGBW brightness value of the two pixels is averaged to be brightness values of rendered RGB three-sub-pixels to obtain the second RGBW brightness values, the specific formula is:

$$\begin{cases} W_{2'} = P_3 \\ R_{2'} = \dfrac{(R_3 + R_4)}{2} \\ G_{2'} = \dfrac{(G_3 + G_4)}{2} \\ B_{2'} = \dfrac{(B_3 + B_4)}{2} \end{cases}.$$

As $P_3$ is dim and $P_4$ is bright, the result is a more sharp difference between contrasts in light, which can improve a display effect of texts.

In the rendering process above, most of the sub-pixel information is maintained, only some information of dim sub-pixels is abandoned, which has little influence on display details.

The examples of the text mode above are all illustrated in an arrangement of W in front of RGB sub-pixels. If the arrangement is W following the RGB sub-pixels, the process is reverse.

In the four calculated pixels above, in an order of two as a group, when a total brightness value $P_1$ of pixel on the left is smaller than a total brightness value $P_2$ of the pixel on the right of the two pixels in the group on the left side, a sum of the brightness values of the W sub-pixels in the first RGBW brightness value of the two pixels is averaged to be the brightness value of rendered W sub-pixel, and the total brightness value $P_2$ of the pixel on the right is regarded as the brightness value of rendered RGB three sub-pixels respectively, so as to obtain the second RGBW brightness value, a specific formula is:

$$\begin{cases} W_{1'} = \dfrac{(W_1 + W_2)}{2} \\ R_{1'} = P_2 \\ G_{1'} = P_2 \\ B_{1'} = P_2 \end{cases}$$

In the four calculated pixels, when a total brightness value $P_3$ of pixel on the left of the two pixels in the group on the right side is smaller than a total brightness value $P_4$ of the pixel on the right, the total brightness value $P_3$ of pixel on the left acts as the brightness value of rendered W sub-pixel, a sum of brightness values of RGB three sub-pixels respectively in the first RGBW brightness value of the two pixels is averaged to be brightness values of rendered RGB three-sub-pixels to obtain the second RGBW brightness values, the specific formula is:

$$\begin{cases} W_{2'} = P_3 \\ R_{2'} = \dfrac{(R_3 + R_4)}{2} \\ G_{2'} = \dfrac{(G_3 + G_4)}{2} \\ B_{2'} = \dfrac{(B_3 + B_4)}{2} \end{cases}.$$

In the disclosure, the processes of De-Gamma conversion and the Gamma conversion are achieved by following formulas respectively:

$$\text{De-Gamma conversion: } y = (x/255)^{gamma};$$

$$\text{Gamma conversion: } x = (y/255)^{\frac{1}{gamma}}$$

In the formulas above, y is the grayscale value, x is the brightness value, gamma is 2.2.

In the disclosure, converting the brightness values of RGB to the first RGBW brightness values can be achieved by:

$$\begin{cases} W = \min(k*R, k*G, k*B, W_{max}) \\ R = k*R - W \\ G = k*G - W \\ B = k*B - W \end{cases}$$

k is a gain coefficient assigned by display contents, $2.5 \geq k \geq 1$.

The disclosure has following advantages.

(1): Adoption of the pixel rendering method can prevent practical resolution from reduction while physical resolution is decreased.

(2): All the sub-pixel information can be maintained in the process of pixel rendering, details will not be lost.

(3): The disclosure determines aiming at different display modes, the text mode and the image mode are processed respectively.

(4): The result of processing images is to smooth display effects of images, especially portraits.

(5): The result of processing texts is to highlight difference between black and white in displaying texts, details are further sharpened.

Although the disclosure is illustrated with reference to specific embodiments, a person skilled in the art should understand that various modifications on forms and details can be achieved within the spirit and scope of the disclosure limited by the claims and the counterpart.

What is claimed is:

1. A RGBW pixel rendering device for a display panel, the rendering device comprising:

a collecting module, configured to obtain a RGB grayscale value of three primary color components of each pixel of an original image in a RGB color space;

converters, coupled to the collecting module and configured to convert the RGB grayscale value to obtain a brightness value of RGB by De-Gamma conversion and covert a second RGBW brightness value to obtain a RGBW grayscale value of a pixel by Gamma conversion then output the RGBW grayscale value;

a sampler, coupled to the converters and configured to convert the brightness value of RGB to a first RGBW brightness value;

a determining element, configured to obtain saturation values and brightness values of two pixels in each group in the original image with two pixels as a group, and obtain a saturation difference and a brightness difference by respective subtraction of the saturation values and the brightness values then obtain an outcome according to the saturation difference and the brightness difference of the two pixels in each groups;

a rendering element, coupled to the sampler and the determining element and configured to render the first RGBW brightness value according to the outcome to obtain the second RGBW brightness value.

2. The RGBW pixel rendering device according to claim 1, wherein the converters comprise a first converter and a second converter;

the first converter, configured to obtain the brightness value of RGB by De-Gamma conversion of the RGB grayscale value and send the brightness value of RGB to the sampler;

the second converter, configured to obtain the RGBW grayscale value of the pixel by Gamma conversion of the second RGBW brightness value and output the RGBW grayscale value.

3. The RGBW pixel rendering device according to claim 2, wherein a determining criterion of the determining element determining according to the saturation difference and the brightness difference of two pixels in each of the groups is determining if the saturation differences of each of the groups are less than a first threshold and the brightness differences of each of the groups are more than a second threshold, if the saturation differences of each of the groups are less than the first threshold and the brightness differences of each of the groups are more than the second threshold, the determining element determines the original image to be a text mode, otherwise, the determining element determines the original image to be an image mode.

4. The RGBW pixel rendering device according to claim 3, wherein when the outcome is the image mode, the rendering element renders by averaging a sum of the brightness values of sub-pixels of an identical type in the first RGBW brightness values of two pixels of each of the groups to obtain the second RGBW brightness value.

5. The RGBW pixel rendering device according to claim 3, wherein when the outcome is the text mode, the rendering element calculates total brightness values of the first RGBW brightness values of two pixels of each of the groups respectively, and determines the total brightness values of the two pixels to obtain the corresponding second RGBW brightness value, calculation of the total brightness value of the pixels follows a formula below:

$$P_n = W_n + \frac{R_n + G_n + B_n}{3}$$

brightness values of four sub-pixels comprised in the first RGBW brightness value of the pixel are respectively $W_n$, $R_n$, $G_n$; $B_n$, n is a serial number of a position where the pixel is in the original image, $P_n$ is the total brightness value of the pixel, the formula above obtains the total brightness value of the first RGBW brightness value of the pixel;

when the total brightness value of the pixel on the left of the two pixels in each of the groups is larger than the total brightness value of the pixel on the right of the two pixels in each of the groups, a sum of brightness values of a W sub-pixel in the first RGBW brightness value of the two pixels is averaged to be the brightness value of rendered W sub-pixel, the total brightness values of the pixels on the right side are regarded as brightness values of rendered RGB three sub-pixels respectively, so as to obtain the second RGBW brightness value;

when the total brightness value of the pixels on the left is smaller than the total brightness value of the pixels on the right, the total brightness of the pixels on the left is regarded as the brightness value of rendered W sub-pixel, a sum of brightness values of a R sub-pixel in the first RGBW brightness value of the two pixels is averaged to be the brightness value of rendered R sub-pixel, a sum of brightness values of a G sub-pixel in the first RGBW brightness value of the two pixels is averaged to be the brightness value of rendered G sub-pixel, a sum of brightness values of a B sub-pixel in the first RGBW brightness value of the two pixels is averaged to be the brightness value of rendered B sub-pixel, the second RGBW brightness value is achieved.

6. A RGBW pixel rendering method for a display panel, comprising following steps:

step 1, obtaining a RGB grayscale value of three primary color components of each pixel of an original image in a RGB color space by a collecting module;

step 2, converting the RGB grayscale value to obtain a brightness value of RGB by De-Gamma conversion by converters;

step 3, converting the brightness value of RGB to a first RGBW brightness value by a sampler;

step 4, obtaining saturation values and brightness values of two pixels in each group in the original image with two pixels as a group, obtaining a saturation difference and a brightness difference by respective subtraction of the saturation values and the brightness values, then obtaining an outcome according to the saturation difference and the brightness difference of the two pixels in each group by a determining element;

step 5, rendering the first RGBW brightness value according to the outcome to obtain a second RGBW brightness value by a rendering element;

step 6, obtaining a RGBW grayscale value of a pixel by Gamma conversion of the second RGBW brightness value and outputting the RGBW grayscale value by the converters.

7. The RGBW pixel rendering method according to claim 6, wherein the converters comprise a first converter and a second converter;

after the collecting module sends the RGB grayscale value to the converter, the first converter obtains the brightness value of RGB by De-Gamma conversion of the RGB grayscale value and sends the brightness value of RGB to the sampler;

after the rendering element sends the rendered second RGBW brightness value to the converters, the second converter obtains a RGBW grayscale value of the pixel by Gamma conversion of the second RGBW brightness value and outputs the RGBW grayscale value.

8. The RGBW pixel rendering method according to claim 7, wherein a determining criterion of the determining element determining according to the saturation difference and the brightness difference of two pixels in each of the groups is:

determining if the saturation differences of each of the groups are less than a first threshold and the brightness differences of each of the groups are more than a second threshold, if the saturation differences of each of the groups are less than the first threshold and the brightness differences of each of the groups are more than the second threshold, the determining element determines the original image to be a text mode, otherwise, the determining element determines the original image to be an image mode.

9. The RGBW pixel rendering method according to claim 8, wherein when the outcome is the image mode, the rendering element renders by averaging a sum of the brightness values of sub-pixels of an identical type in the first RGBW brightness values of two pixels of each of the groups to obtain the second RGBW brightness value.

10. The RGBW pixel rendering method according to claim 8, wherein when the outcome is the text mode, the rendering element calculates total brightness values of the first RGBW brightness values of two pixels of each of the groups respectively, and determines the total brightness value of the two pixels to obtain the corresponding second RGBW brightness value, calculation of the total brightness value of the pixels follows a formula below:

$$P_n = W_n + \frac{R_n + G_n + B_n}{3}$$

brightness values of four sub-pixels comprised in the first RGBW brightness value of the pixel are respectively Wn, Rn, Gn and Bn, n is a serial number of a position where the pixel is in the original image, Pn is the total brightness value of the pixel, the formula above obtains the total brightness value of the pixel;

when the total brightness value of the pixel on the left of the two pixels in each of the groups is larger than the total brightness value of the pixel on the right of the two pixels in each of the groups, a sum of brightness values of a W sub-pixel in the first RGBW brightness value of the two pixels is averaged to be the brightness value of rendered W sub-pixel, the total brightness values of the pixels on the right side are regarded as brightness values of rendered RGB three sub-pixels respectively, so as to obtain the second RGBW brightness value;

when the total brightness value of the pixels on the left is smaller than the total brightness value of the pixels on the right, the total brightness value of the pixels on the left is regarded as the brightness value of rendered W sub-pixel, a sum of brightness values of a R sub-pixel in the first RGBW brightness value of the two pixels is averaged to be the brightness value of rendered R sub-pixel, a sum of brightness values of a G sub-pixel in the first RGBW brightness value of the two pixels is averaged to be the brightness value of rendered G sub-pixel, a sum of brightness values of a B sub-pixel in the first RGBW brightness value of the two pixels is averaged to be the brightness value of rendered B sub-pixel, the second RGBW brightness value is achieved.

* * * * *